US007692621B2

(12) United States Patent
Song

(10) Patent No.: US 7,692,621 B2
(45) Date of Patent: Apr. 6, 2010

(54) LIQUID CRYSTAL DISPLAY DEVICE AND A METHOD FOR DRIVING THE SAME

(75) Inventor: Jang-Kun Song, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1295 days.

(21) Appl. No.: 10/488,067

(22) PCT Filed: Aug. 26, 2002

(86) PCT No.: PCT/KR02/01606

§ 371 (c)(1),
(2), (4) Date: Feb. 26, 2004

(87) PCT Pub. No.: WO03/019271

PCT Pub. Date: Mar. 6, 2003

(65) Prior Publication Data

US 2004/0183773 A1 Sep. 23, 2004

(30) Foreign Application Priority Data

Aug. 28, 2001 (KR) ..... 2001-0052236

(51) Int. Cl.
*G09G 3/36* (2006.01)

(52) U.S. Cl. ..... 345/102; 345/84

(58) Field of Classification Search ..... 345/84–102, 345/103, 204, 211, 212; 315/200, 224, 225, 315/169.1, 169.3; 362/30, 246, 800
See application file for complete search history.

(56) References Cited

U.S. PATENT DOCUMENTS 5,132,839 A 7/1992 Travis ..... 359/462
5,675,357 A * 10/1997 Yoshida et al. ..... 345/104
6,535,195 B1 * 3/2003 Nelson ..... 345/102
6,947,024 B2 * 9/2005 Lee et al. ..... 345/102
6,956,555 B2 * 10/2005 Kyomoto ..... 345/102
7,126,575 B2 * 10/2006 Kim et al. ..... 345/102
7,183,725 B2 * 2/2007 Kim ..... 315/291

(Continued)

FOREIGN PATENT DOCUMENTS

EP 0 942 404 A2 9/1999

(Continued)

OTHER PUBLICATIONS

Office Action from KIPO, 9-5-2007-045837022 (4 pages).

(Continued)

*Primary Examiner*—Nitin Patel
(74) *Attorney, Agent, or Firm*—Innovation Counsel LLP

(57) ABSTRACT

Disclosed are a liquid crystal display device and a method for driving the same. After all the gate lines included in each effective display region divided into several regions, are turned on, a light is supplied to a liquid crystal after all the liquid crystals are completely arranged, but the light is not applied to a portion of the effective display regions until all the liquid crystals are completely arranged. The process is repeatedly performed concerning each effective display region. Thus, the poor quality of display image such as image spreading phenomenon of the moving image can be prevented. Also, the light supply time can greatly increase, thereby accomplishing an image display with a high brightness.

11 Claims, 13 Drawing Sheets

U.S. PATENT DOCUMENTS

| | | | | |
|---|---|---|---|---|
| 7,233,304 | B1 * | 6/2007 | Aratani et al. | 345/87 |
| 2002/0070914 | A1 * | 6/2002 | Bruning et al. | 345/102 |
| 2005/0206589 | A1 * | 9/2005 | Miyachi et al. | 345/73 |

FOREIGN PATENT DOCUMENTS

| | | |
|---|---|---|
| WO | WO 99/00993 | 1/1999 |
| WO | WO 00/03377 | 1/2000 |

OTHER PUBLICATIONS

Korean Patent Abstract, Publication No. 1020000062993 A, Oct. 25, 2000, Application No. 1020000014728, Date of filing Mar. 23, 2000 (2 pages).

* cited by examiner

LIQUID CRYSTAL DISPLAY DEVICE AND A METHOD FOR DRIVING THE SAME

TECHNICAL FIELD

The present invention relates to a liquid crystal display device and a method for driving thereof, and more particularly to a liquid crystal display device suitable for precisely displaying a moving image and a method for driving the same.

BACKGROUND ART

In general, a liquid crystal display device displays images including letters, still images, moving images and so on. To display those images, the liquid crystal display device precisely controls a minute area of a liquid crystal. The light transmissivity of the liquid crystal varies in accordance with the strength of an electric field applied thereto.

The liquid crystal display device generally includes a transparent pixel electrode, a transparent common electrode, and a liquid crystal formed between the two electrodes. The pixel electrode formed on a transparent substrate is divided to have a matrix shape and to form minute regions on the transparent substrate. An electric power is applied to the pixel electrode. The common electrode is formed on the whole surface of another transparent substrate.

The liquid crystal display device can display images by precisely controlling the strength of the electric power applied to the pixel electrode while an electric power is applied to the common electrode as a reference electric power. In this case, the strength of the electric power applied to the pixel electrode is controlled by a thin film transistor manufactured by a semiconductor technology.

The thin film transistor includes a gate electrode, a channel layer formed over the gate electrode and insulated from the gate electrode, a source electrode, and a drain electrode. The source and the drain electrodes are formed to not be electrically short with the channel layer.

The pixel electrode is electrically connected to the drain electrode of the thin film transistor. Also, the electric power is applied to the source electrode of the thin film transistor so as to be applied to the pixel electrode, and an electric power for turning on the thin film transistor is applied to the gate electrode of the thin film transistor so that the electric power is applied from the source electrode to the drain electrode on a pertinent time.

The resolution of the liquid crystal display device is determined by the integration degree of the pixel electrodes. For example, when the liquid crystal display device displays full color images with a resolution of 800×600 in a unit effective display region, the number of the pixel electrodes should be 800×600×3, and the number of the thin film transistors should match with that of the pixel electrodes.

FIG. 1 is a schematic plane view explaining the conventional method for driving a liquid crystal display device.

Referring to FIG. 1, thin film transistors 30 are arranged on a substrate 40 in a matrix shape, and gate electrodes, which is arranged along each row of the matrix, of all the thin film transistors 30 are connected to a gate line 10. Also, source electrodes, which are arranged along each column of the matrix, of all the transistors 30 are connected to a data line 20.

To apply predetermined electric power to each pixel electrode, electric power is applied to a first, second, third, . . . , and last data line. While the electric power is applied to each data line 20, a first gate line 10 is selected, and then a threshold voltage ($V_{th}$) is applied to the selected first gate line 10.

Hence, all the thin film transistors 30 connected to the first gate line 10 are turned on. According to the turn-on of the thin film transistor 30, the electric power applied to the source electrode is applied to the pixel electrode via a drain electrode.

Thus, an electric field is formed between the pixel electrode and a common electrode. In this case, a liquid crystal is arranged by the electric field, and then a light can pass through the liquid crystal after a predetermined time. The amount of the light passing the liquid crystal varies in accordance with the arrangement of the liquid crystal. Then, the light passed the liquid crystal progresses to a color pixel. Such process is sequentially performed in the first, second, third, . . . and last gate line during one frame. A user can recognize a still image or the moving image because the frame is very rapidly executed for one second.

However, the liquid crystal display device having those construction and operation mechanism may not accurately display the moving image. The liquid crystal display device can display the moving image when a response speed and an operation speed of the liquid crystal are equal to or faster than the number of the frames of the moving image.

When the liquid crystal has a slow response speed and a lower operation speed, the liquid crystal display device cannot display the moving image. In particular, the image spread phenomenon and the image distortion phenomenon may occur because the liquid crystal is not sufficiently arranged when the response speed and the operation speed of the liquid crystal are low.

Recently, the response speed and the operation speed of the liquid crystal have been improved so that the liquid crystal display device can display the moving image.

However, there are limits to enhance the response speed and the operation speed of the liquid crystal, so a frame frequency should be at least doubly increased than that of the present liquid crystal display device in order to display more precise moving image. For example, the frequency demanded for displaying the precise moving image should be about 120 Hz when the present frame frequency is approximately 60 Hz.

However, if the frame frequency increases, a point of time when the driving signal is applied to the gate electrode and another point of time of the data driving signal is applied to the source electrode should be changed, and also other driving signal such as a timing driving signal should be varied. As a result, the constructions of the hardware of the liquid crystal display device should be altered.

Particularly, when the frame frequency is high, the above-mentioned problem cannot be solved basically since the period demanded for processing one frame is exceedingly reduced and the response speed of the liquid crystal should be high. In addition, the liquid crystal display device may not accurately display the moving image according as the liquid crystal display device has a high resolution.

In the meantime, according to another method for displaying the moving image through the liquid crystal display device, the screen of the liquid crystal display is maintained black for a predetermined time, which is similar to a driving method of a cathode ray tube (CRT) type display device.

FIG. 2 is a graph showing a period during which a light is supplied in one frame when the conventional liquid crystal display device operates.

Referring to FIG. 2, for example, when the liquid crystal display panel requires a totally approximately 16.7 msec in order to display all images during one frame, all thin film transistors should be turned on within approximately 8 msec to arrange the liquid crystal before the light is supplied to the liquid crystal, and then the light is supplied to the liquid crystal only during the residuary period of approximately 8.7 msec.

In the above-described method, however, the period for processing one frame includes the period for turning on all thin film transistors and the period for supplying the light to the liquid crystal. This method has a disadvantage that the brightness is greatly reduced to deteriorate the display quality of the image according as the screen of the liquid crystal display device becomes large, or according as the number of the thin film transistor increases.

DISCLOSURE OF THE INVENTION

The present invention has been made to solve the aforementioned problem, and accordingly it is a first object of the present invention to provide a liquid crystal display device that can precisely display a moving image with a high brightness.

It is a second object of the present invention to provide a method for driving a liquid crystal display device precisely displaying a moving image with a high brightness.

To achieve the first object of the present invention, there is provided a liquid crystal display device including a liquid crystal display panel assembly and a backlight assembly. The liquid crystal display panel assembly comprises a thin film transistor substrate, a color filter substrate, a liquid crystal display panel, a gate printed circuit board, and a data printed circuit board, the two printed circuit boards being hereinafter collectively referred to as a driving circuit part.

The thin film transistor substrate includes thin film transistors having gate electrodes, source electrodes and drain electrodes, gate lines connected to the gate electrodes, data lines connected to the source electrodes, and pixel electrodes connected to the drain electrodes. The color filter substrate faces to the thin film transistor substrate wherein common electrodes are formed on the color filter substrate. The liquid crystal display panel has a liquid crystal interposed between the thin film transistor substrate and the color filter substrate. The gate printed circuit board applies a gate driving signal to the gate lines, and the data printed circuit board applies a data driving signal to the data lines, the gate printed circuit board and the data printed circuit board being collectively referred to as the driving circuit part.

The back light assembly comprises a signal synchronism part, an inverter, and at least two lamps. The signal synchronism part detects a gate line to which the gate driving signal is applied to generate an inverter control signal. The inverter receives the inverter control signal to generate a lamp driving signal. At least two lamps are parallel disposed under the liquid crystal display panel to be turned on or turned off in response to the lamp driving signal.

Also, to achieve the second object of the present invention, there is provided a method for driving a liquid crystal display device comprising the steps of i) applying an electric field to a liquid crystal included in a first region of a liquid crystal display panel to arrange the liquid crystal, the liquid crystal display panel being divided into a plurality of regions, ii) stopping supplying a light to the liquid crystal during a predetermined period of arranging the liquid crystal included in the first region, iii) supplying the light to the liquid crystal included in the first region after the predetermined period of arranging the liquid crystal included in the first region, and iv) repeating the steps ii) and iii) concerning liquid crystals included in other regions of the liquid crystal display panel.

According to the present invention, an effective display area where an image is displayed by the line is divided into a plurality of regions. A light is not supplied to a predetermined region for a period for arranging a liquid crystal positioned in the predetermined region. After the liquid crystal positioned in the predetermined region is completely arranged, the light is supplied to the liquid crystal in the predetermined region, and then the light is repeatedly supplied to other regions until one frame is processed. Therefore, the image spreading phenomenon can be prevented as well as the display brightness can be greatly enhanced when the liquid crystal display device displays a moving image.

That is, while the effective display area of the liquid crystal display panel is imaginarily divided into a plurality of regions in accordance with the number of the lamps, after all the thin film transistors in a specific region of the liquid crystal display panel are turned on, the light is supplied to the liquid crystal in the specific region of the liquid crystal display panel when the liquid crystal is completely arranged in the specific region, but the light is not applied to the liquid crystal until the liquid crystal is completely arranged. Therefore, the image spreading phenomenon and the image distortion phenomenon can be prevented when displaying moving images. Also, the deterioration of the brightness can be prevented.

BRIEF DESCRIPTION OF THE DRAWINGS

The above and other objects and advantages of the present invention will become readily apparent by reference to the following detailed description when considered in conjunction with the accompanying drawings wherein.

BEST MODE FOR CARRYING OUT THE INVENTION

Hereinafter, a liquid crystal display device according to the preferred embodiments of the present invention will be described in detail with reference to the accompanying drawings.

Figure 3:
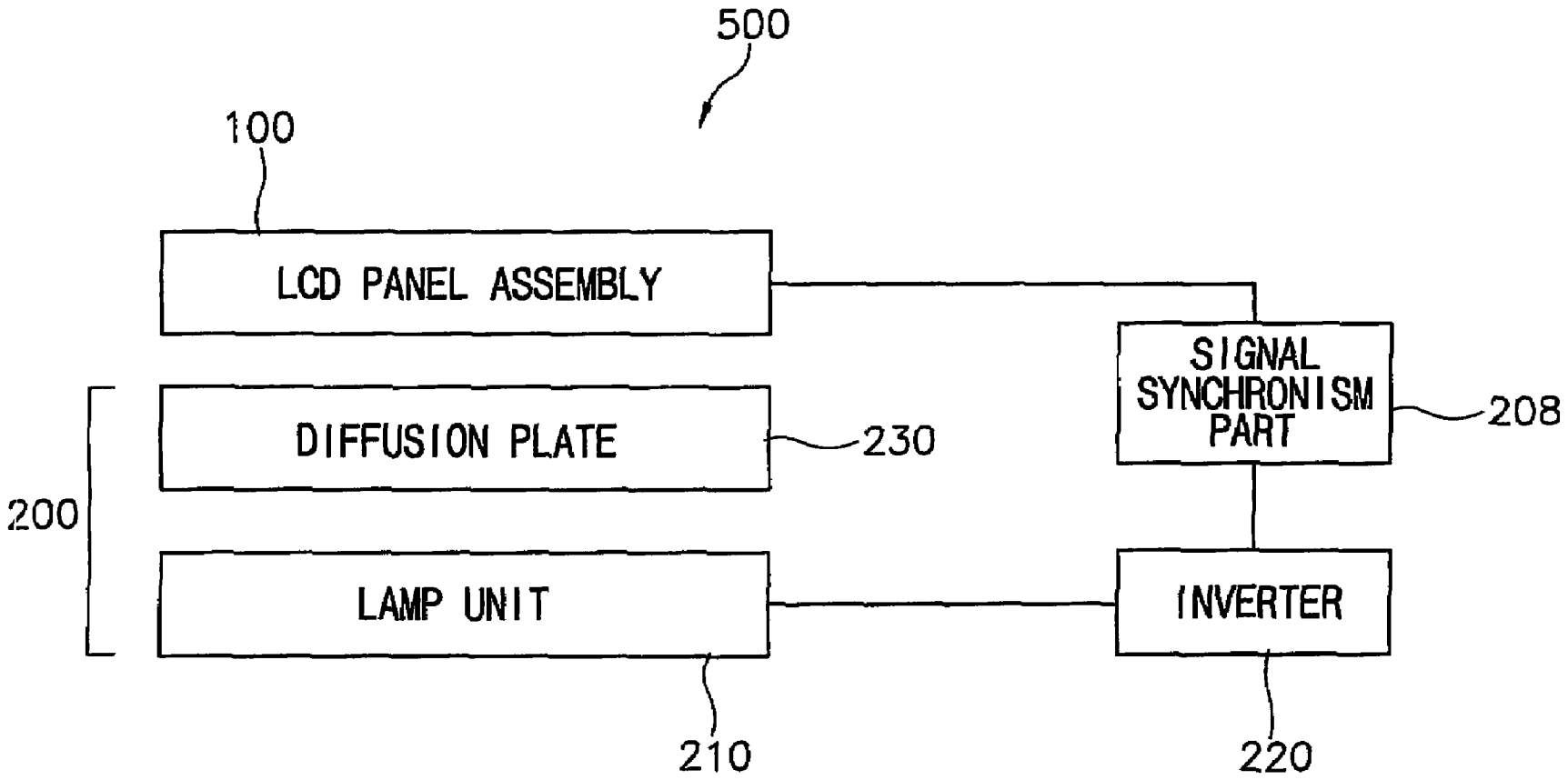
FIG. 3 is a block diagram showing a liquid crystal display device according to one embodiment of the present invention.

FIG. 3 is a block diagram showing a liquid crystal display device according to one embodiment of the present invention.

Referring to FIG. 3, a liquid crystal display device 500 according to one embodiment of the present invention includes a liquid crystal display panel assembly 100 and a back light assembly 200.

The liquid crystal display panel assembly 100 has a predetermined effective display area, and precisely controls a liquid crystal of the liquid crystal display device 500 by controlling a minute area of the liquid crystal. The back light assembly 200 provides a light to the liquid crystal of the liquid crystal display panel assembly 100.

Figure 4A:
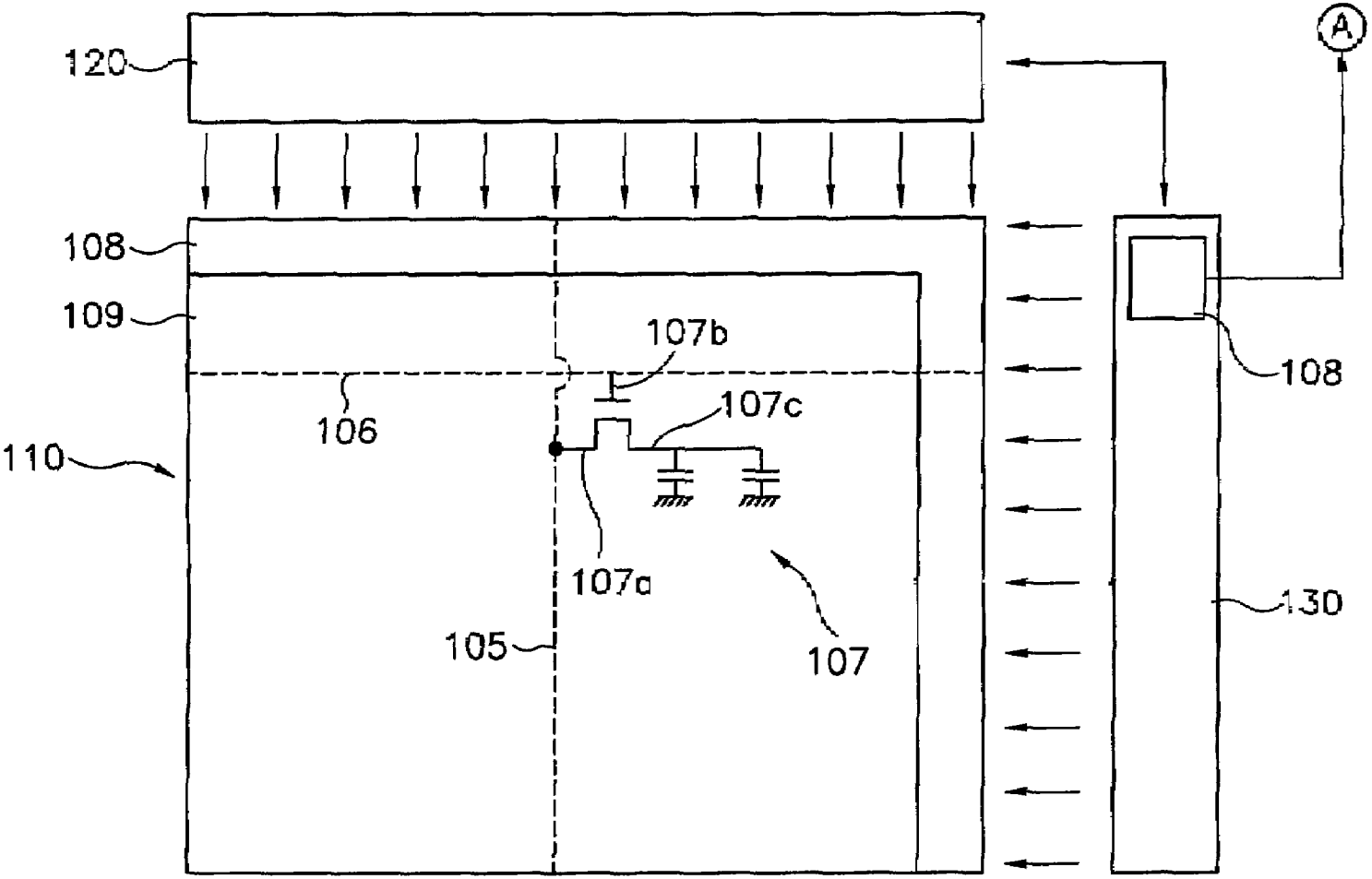
FIG. 4*a* is a schematic plane view showing the liquid crystal display device according to one embodiment of the present invention.

FIG. 4*a* is a schematic plane view showing the liquid crystal display device according to one embodiment of the present invention.

Referring to FIG. 4*a*, the liquid crystal display panel assembly 100 includes a liquid crystal display panel 110, a data printed circuit board 120, a gate printed circuit board 130, and a flexible printed circuit (not shown). Regarding the data printed circuit board 120 and the gate printed circuit board 130. these printed circuit boards taken together are herein sometimes referred to as the driving circuit part.

The liquid crystal display panel 110 has a thin film transistor (TFT) substrate 108, a color filter substrate 109, and the liquid crystal (not shown).

The TFT substrate 108 includes thin film transistors 107 formed on a transparent substrate, wirings for applying signals 105 and 106, and pixel electrodes.

The thin film transistors 107 and the pixel electrodes are formed on the transparent substrate. In this case, the thin film transistors 107 are arranged on the transparent substrate in a matrix shape by means of a semiconductor manufacturing technology.

The number of the thin film transistor 107 is related to a resolution of the liquid crystal display device 500. For example, the number of the thin film transistors 107 should be 800×600×3 when the liquid crystal display device 500 has a display resolution of 800×600 in a full color display mode.

Each thin film transistor 107 has a source electrode 107*a*, a gate electrode 107*b*, and a drain electrode 107*c*. The TFT substrate 108 can be divided into numerous regions by means of the thin film transistors 107, and electric powers applied to each regions of the TFT substrate 108 can be individually controlled.

To individually control the thin film transistors 107, data lines 105 are commonly connected to the source electrodes 107*a* of the thin film transistors 107 disposed along columns of the matrix among the thin film transistors 107 arranged in the matrix shape In addition, gate lines 106 are commonly connected to the gate electrodes 107*b* of the thin film transistors 107 disposed along rows of the matrix among the thin film transistors 107 arranged in the matrix shape in order to independently control the thin film transistors 107.

Meanwhile, transparent pixel electrodes are formed to contact with the drain electrode 107*c* of the thin film transistors 107.

The color filter substrate 109 is formed on the TFT substrate 108 having the above-described construction after the color filter substrate 109 is aligned concerning the TFT substrate 108. Common electrodes and red- green- blue (R-G-B) pixels are formed on the color filter substrate 109.

The liquid crystal is interposed between the TFT substrate 108 and the color filter substrate 109 to complete the liquid crystal display panel 110.

To display a demanded image on the liquid crystal display panel 110 having the above-mentioned construction, data applied to the source electrodes 107*a* of the thin film transistors 107 should be precisely controlled, and turn-on periods concerning the gate electrodes 107*b* of the thin film transistors 107 also should be precisely controlled.

The data printed circuit board 120 is connected to each data line 105 of the thin film transistor 107 through the flexible printed circuit (not shown). The data printed circuit board 120 generates data, and applies the generated data to the data lines 105.

Also, the gate printed circuit board 130 is connected to each gate line 106 of the thin film transistor 107 through the flexible printed circuit (not shown). The gate printed circuit board 130 generates turn-on voltages signal that turns on the thin film transistors 107 disposed in a specific row on a predetermined time.

The liquid crystal can be independently controlled by controlling the minute area of the liquid crystal by the liquid crystal display panel 110 having above construction. However, images may not be displayed on the liquid crystal display panel assembly 100 by the liquid crystal display panel 110 having only above construction because the liquid crystal in the liquid crystal display panel assembly 100 is a non-active device that cannot generate a light by itself. The liquid crystal of the liquid crystal display panel assembly 100 only can control the transmissivity of lights. As a result, lights are required so as to display images on the liquid crystal display panel assembly 100.

Figure 4B:
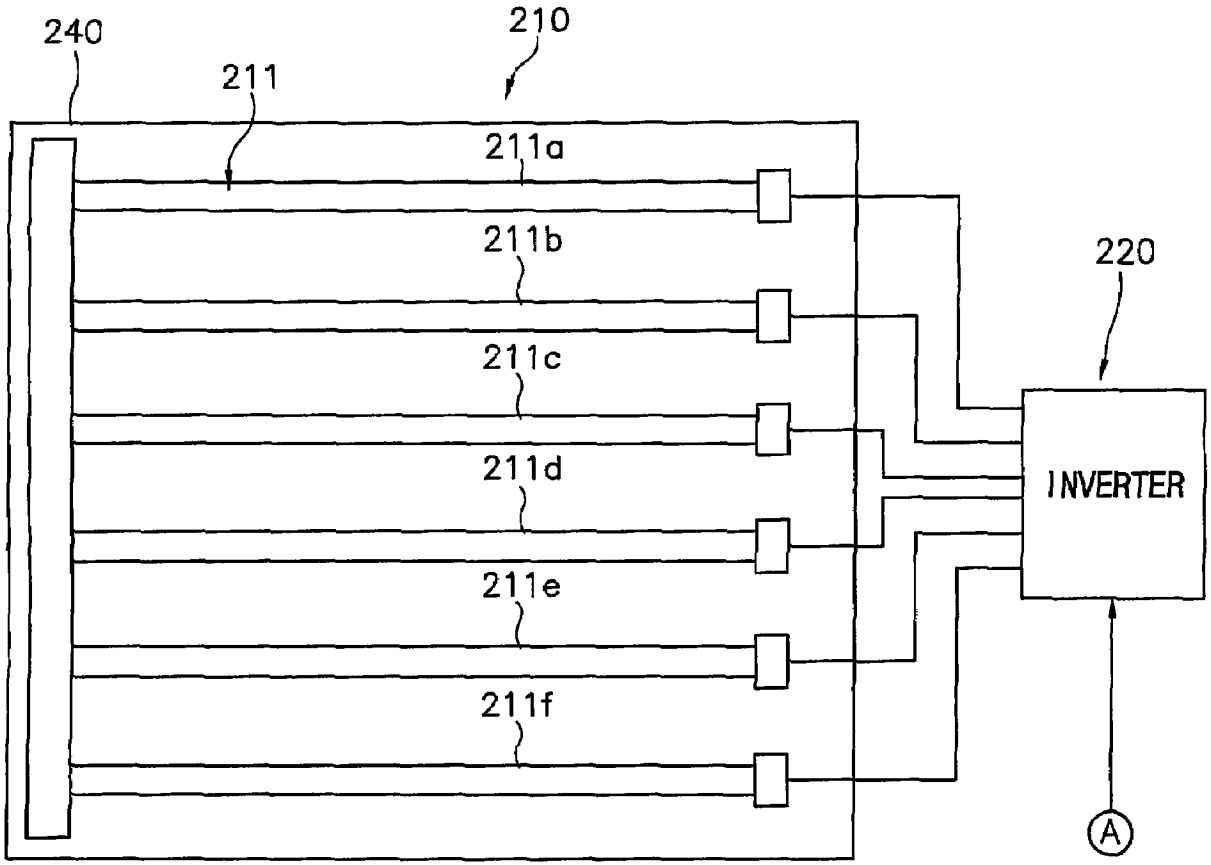
FIG. 4*b* is a schematic plane view illustrating the back light assembly according to one embodiment of the present invention.

FIG. 4*b* is a schematic plane view illustrating the back light assembly according to one embodiment of the present invention.

Referring to FIGS. 3 and 4*b*, the back light assembly 200 includes a lamp 211, an inverter 220, a brightness enhancing member 230 for improving a brightness uniformity of the light generated from the lamp 211, a receiving container 240 and a signal synchronism part 208.

The inverter 220 supplies the lamp 211 with electric power, and the receiving container 240 receives the lamp 211, the inverter 220 and the brightness enhancing member 230. The signal synchronism part 208 prevents the lamp 211 from generating a light during the period for arranging the liquid crystal of the liquid crystal display panel 110 by an electric field.

In particular, a natural light such as sunbeams or an artificial light obtained using an electric energy can be used as a light suitable for displaying images through the liquid crystal display panel assembly 100.

Recently, the artificial light is widely utilized since the artificial light can be used as the light suitable for displaying images through the light the liquid crystal display panel assembly 100 in any place. For example, a white ray similar to the sunrays is used as the artificial light, and a cold cathode ray tube type lamp is utilized because the cold cathode ray tube type lamp has a long life and low heat dissipation.

The cold cathode ray tube type lamps are divided into an edge type lamp and a directly illuminating type lamp in accordance with the position of the liquid crystal display panel assembly 100 concerning the cold cathode ray tube type lamps.

The edge type lamp is usually applied to a display device such as a portable computer including one or two cathode ray tube type lamps. When the edge type lamp is applied to a liquid crystal display device, the liquid crystal display device can have a minimized thickness.

In the meantime, the directly illuminating type lamp is used for a display device having a large display screen or a portable computer having a large display screen when the display device or the portable computer needs at least two lamps.

The directly illuminating type lamps 211 are used in the liquid crystal display device according to the one embodiment of the present invention. In this case, the lamps 211 are mounted under the liquid crystal display panel assembly 100 at intervals of about 0.5 to about 5 cm. That is, the lamps 211 are installed inside the receiving container 240 in parallel. Preferably, six lamps 211 are installed inside the receiving container 240 in parallel.

Hereinafter, six lamps 211 are defined as a first lamp 211*a*, a second lamp 211*b*, a third lamp 211*c*, a fourth lamp 211*d*, a fifth lamp 211*e*, and a sixth lamp 211*f*, respectively.

The first to sixth lamps 211*a*, 211*b*, 211*c*, 211*d*, 211*e* and 211*f* received in the receiving container 240 are connected parallel to one inverter 220 so that the first to sixth lamps 211*a*, 211*b*, 211*c*, 211*d*, 211*e* and 211*f* are independently supplied with electric powers from the inverter 220.

The brightness enhancing member 230 is interposed between the liquid crystal display panel assembly 110 and the first to the sixth lamps 211*a*, 211*b*, 211*c*, 211*d*, 211*e*, and 211*f* so as to enhance the brightness uniformity of the light between the lamps, which is disposed under the liquid crystal display panel assembly 100, and the liquid crystal display panel assembly 100.

In the one preferred embodiment of the present invention, the brightness enhancing member 230 is a diffusion plate for diffusing the light so as to enhance the brightness uniformity of the light.

According to the present invention, the lamp 211*a*, 211*b*, 211*c*, 211*d*, 211*e* and 211*f* of the back light assembly 100 uniquely operates in order to display a precise moving image through the liquid crystal display device 500.

In particular, the lamps 211*a*, 211*b*, 211*c*, 211*d*, 211*e* and 211*f* are turned on or turned off in correspondence with the turn-on or turn-off of the gate line 105 in the liquid crystal display panel 100. The lamps 211*a*, 211*b*, 211*c*, 211*d*, 211*e* and 211*f* can be turned on or turned off by the inverter 220 and the signal synchronism part 208.

The signal synchronism part 208 generates an inverter control signal by detecting the turn-on of the gate line 106. The inverter 220 generates a lamp driving signal in response to the inverter control signal.

More particularly, the signal synchronism part 208 is disposed on the gate printed circuit board 130 so as to minimize a volume of the liquid crystal display device 500. The signal synchronism part 208 detects whether the turn-on voltage is applied to a specific gate line among all the gate lines 106 formed on the liquid crystal display panel 110, and then the signal synchronism part 208 generates the inverter control signal for controlling the inverter 220.

The inverter control signal includes data that indicates a turn-on lamp or turn-off lamp, the turn-on time and the turn-off time of the lamps 211*a*, 211*b*, 211*c*, 211*d*, 211*e* and 211*f*.

The inverter control signal is applied to the inverter 220, and then the inverter 220 provides a related lamp with the electric power among all the lamps 211*a*, 211*b*, 211*c*, 211*d*, 211*e* and 211*f* connected to the inverter 220, so the related lamp can be turned on or turned off.

The operations of the lamps will be described in detail with reference to the accompanying drawings.

Figure 5:
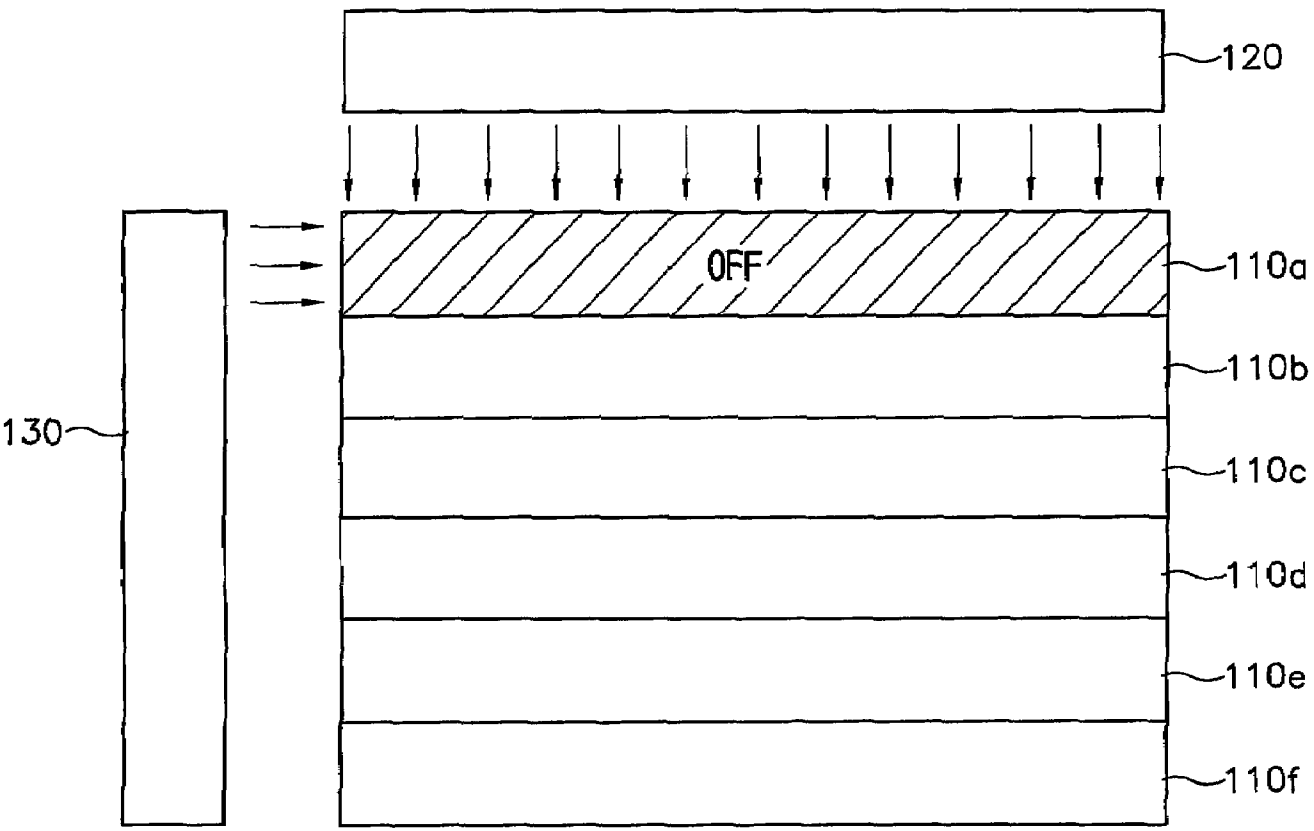
FIG. 5 is a schematic plane view illustrating a state in which the lamps corresponding to a first region are turned off before the liquid crystal in the first region is completely arranged when all the thin film transistors in the first region of the liquid crystal display panel are turned on according to one embodiment of the present invention.

FIG. 5 is a schematic plane view illustrating a state in which the lamps corresponding to a first region are turned off before the liquid crystal in the first region is completely arranged when all the thin film transistors in the first region of the liquid crystal display panel are turned on according to one embodiment of the present invention.

Referring to FIG. 5, the liquid crystal display panel 110 is divided into a plurality of regions in accordance with the number of the lamps 211*a*, 211*b*, 211*c*, 211*d*, 211*e*, and 211*f*.

As it is described above, the liquid crystal display panel 110 is divided into six regions because six lamps 211*a*, 211*b*, 211*c*, 211*d*, 211*e* and 211*f* are used in the liquid crystal display device 500.

Hereinafter, six regions of the liquid crystal display panel 110 are called a first region 110*a*, a second region 110*b*, a third region 110*c*, a fourth region 110*d*, a fifth region 110*e*, and a sixth region 110*f*, respectively.

The image is displayed when the data are applied to all the data line 105, and the turn-on voltage is sequentially applied from an first gate line of the first region 110*a* to an last gate line of the sixth region 110*f* as shown in FIG. 4*a*. Such driving process is called a line driving process.

To precisely display moving images by the liquid crystal display panel 100, the gate driving signal is applied to a first gate line 106 in the first region 110*a* and to a last gate line 106 in the first region 110*a* sequentially.

The signal synchronism part 208 applies the inverter control signal, which is related to the first lamp 211*a* under the first region 110*a*, to the inverter 220 when the signal synchronism part 208 detects the turn-on of the last gate line in the first region 110*a*.

The inverter 220 receives the inverter control signal generated from the signal synchronism part 208, and then stops providing the electric power to the first lamp 211*a* so as to turn off the first lamp 211*a* during the period demanded for completely arranging the liquid crystal in the first region 110*a*.

At that time, users may not perceive the period during which the first lamp 211*a* is turned off since the turn-off period of the first lamp 211*a* corresponds to the very short period during which the liquid crystal is arranged in the direction corresponding to the electric field applied to the liquid crystal.

Then, when the liquid crystal is completely arranged in the first region 110*a*, the inverter 220 applies the electric power to the first lamp 211*a* at a turn-off state, to thereby turn on the first lamp 211*a*. The first lamp 211*a* is maintained at the turn-on state by the inverter 220 until one frame of images is displayed.

Figure 6:
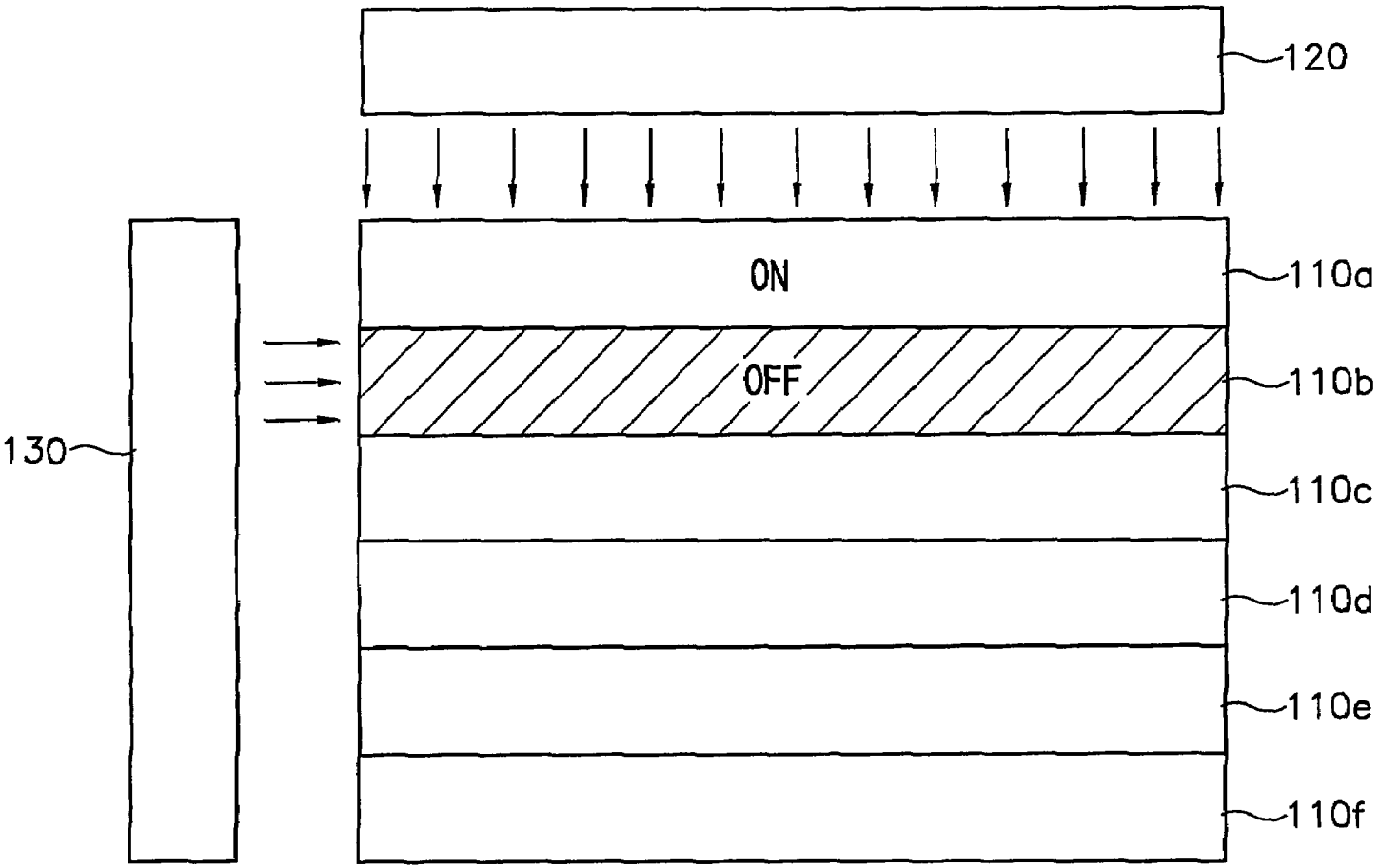
FIG. 6 is a schematic plane view showing a state in which the lamps corresponding to the first region are turned on while the lamps corresponding to a second region are turned off when all the thin film transistors in the second region of the liquid crystal display panel are turned on according to one embodiment of the present invention.
Figure 7:
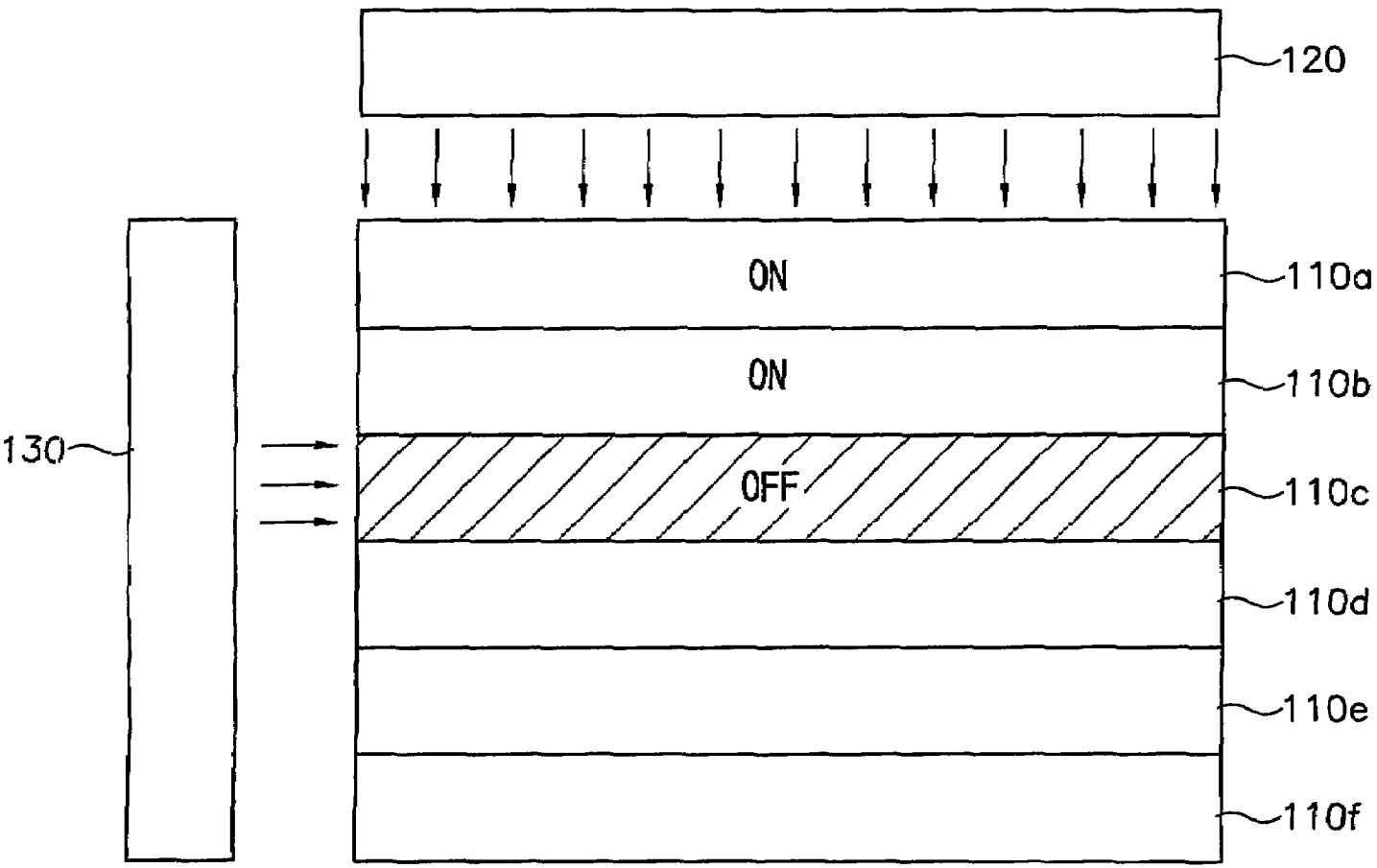
FIGS. 7 to 11 are schematic plane views showing states in which the lamps corresponding to a third, fourth, fifth, and sixth regions of the liquid crystal display panel are turned on sequentially when all the thin film transistors in the third, fourth, fifth, and sixth regions are turned on sequentially, and to thereby complete displaying for one frame according to one embodiment of the present invention.
Figure 8:
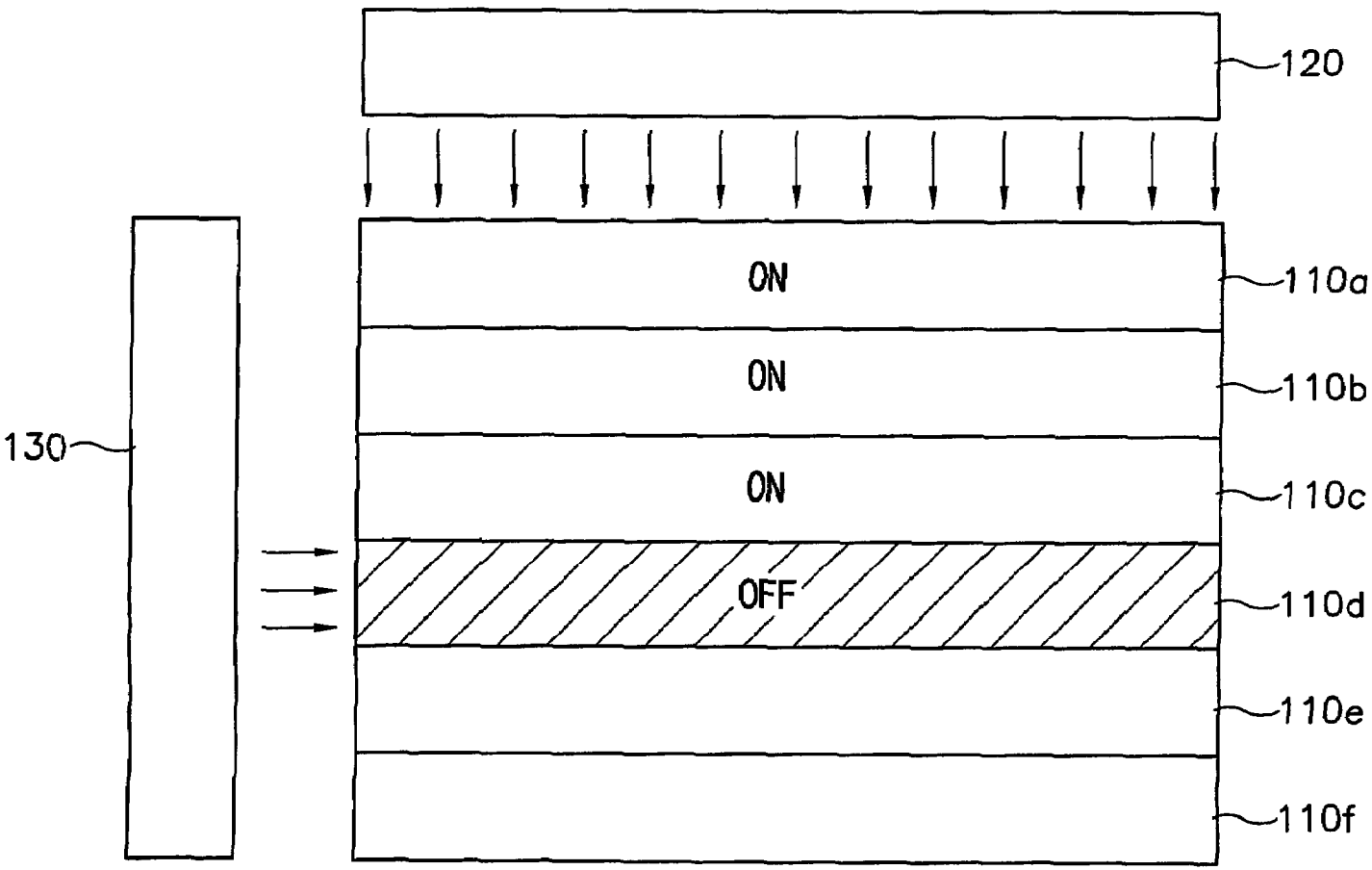
Figure 9:
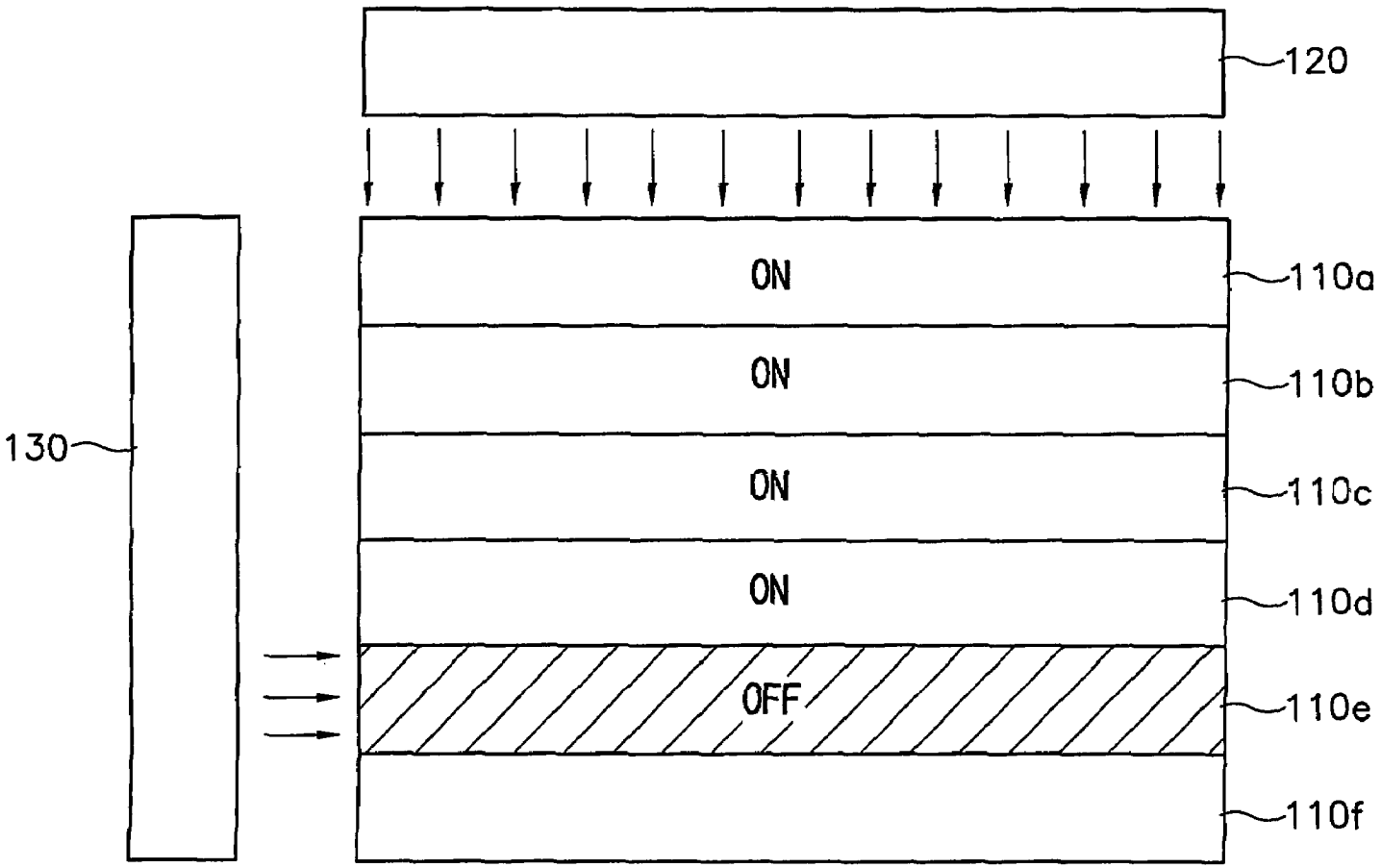
Figure 10:
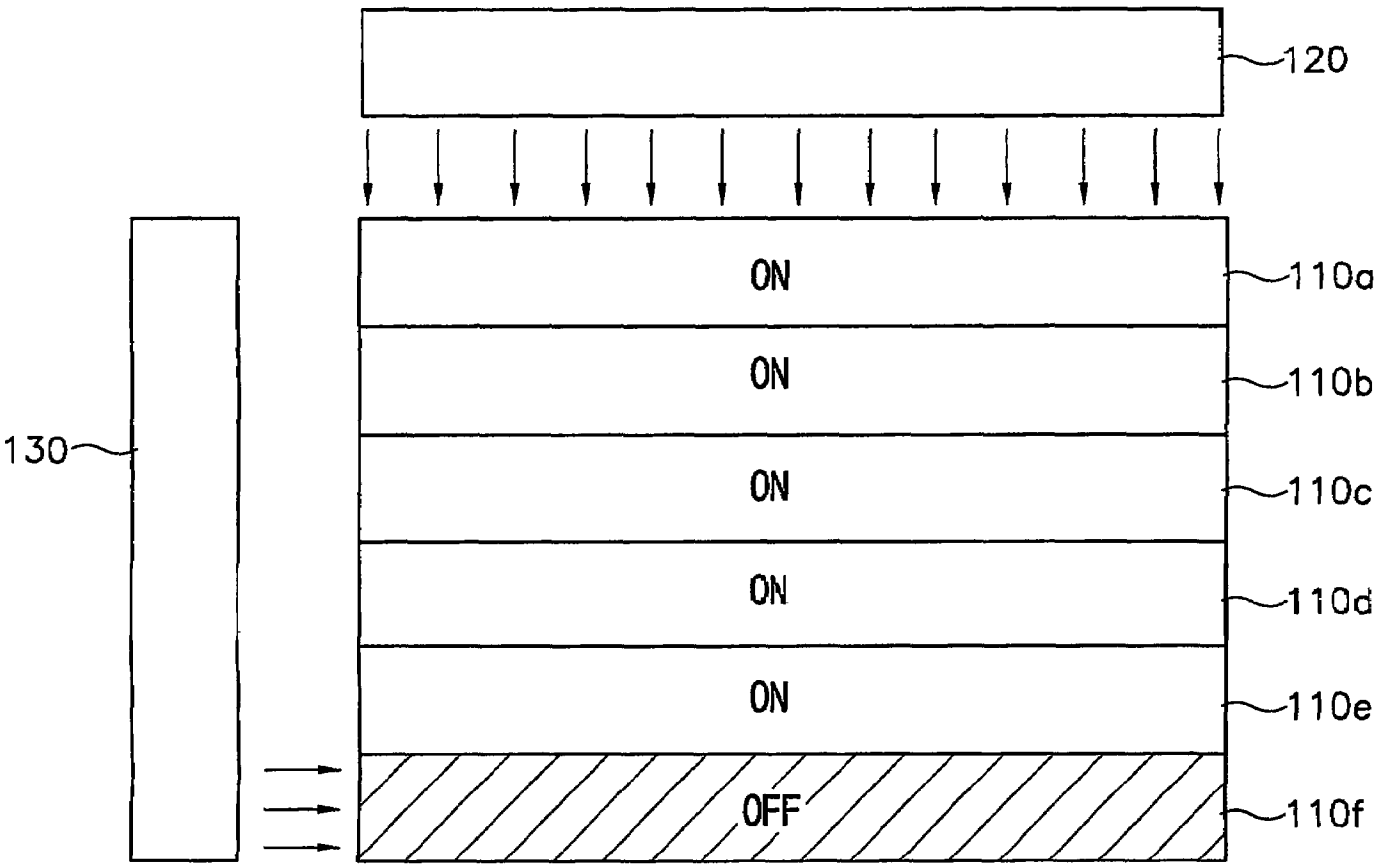
Figure 11:
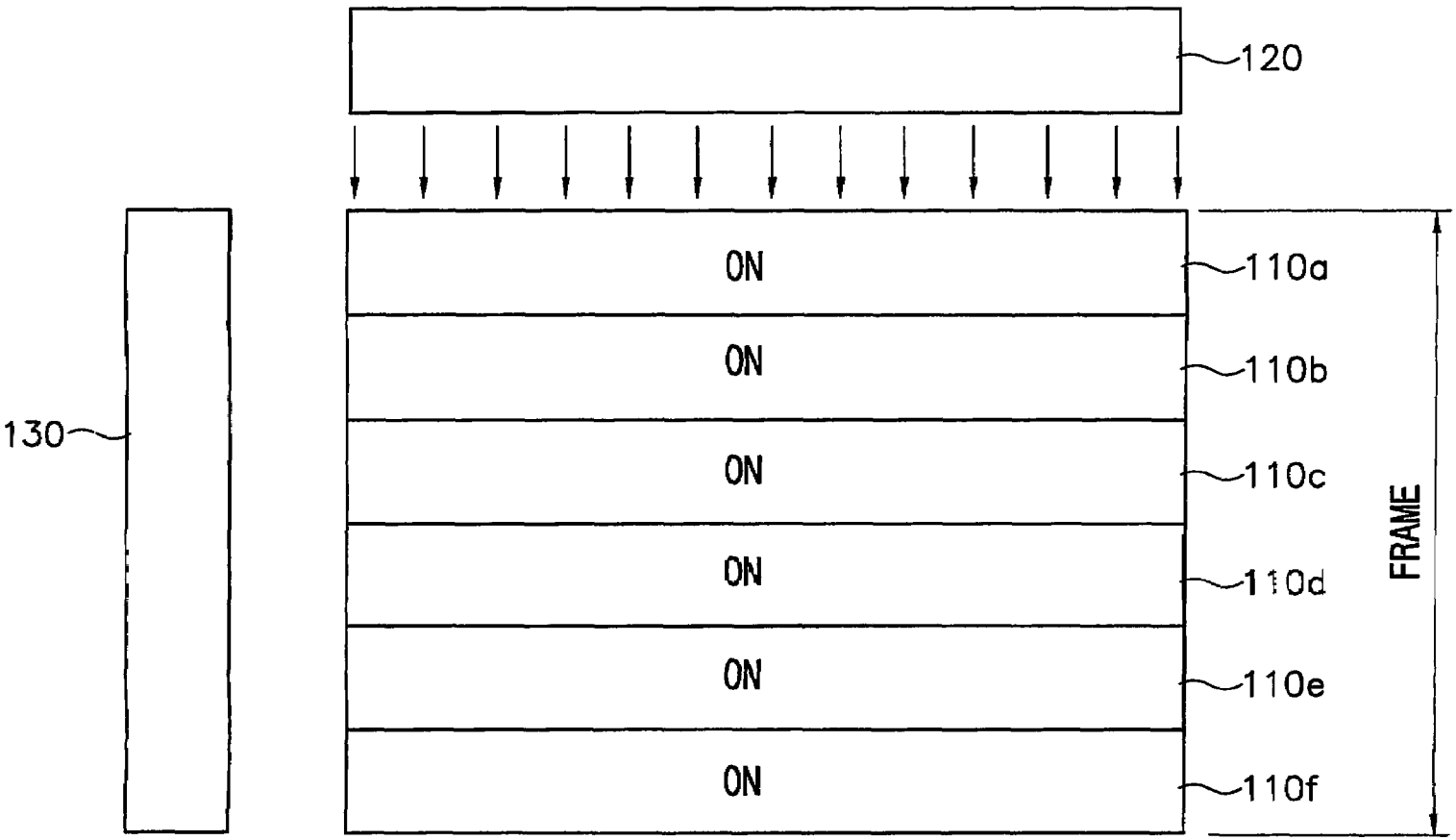

FIG. 6 is a schematic plane view showing a state in which the lamps corresponding to the first region are turned on while the lamps corresponding to a second region are turned off when all the thin film transistors in the second region of the liquid crystal display panel are turned on according to one embodiment of the present invention.

Referring to FIG. 6, the gate lines 106 in the second region 110*b* is turned on sequentially from the first lamp 211*a* to the last lamp 211*a* during a transition period of the first lamp 211 from the turn-off state to the turn-on state by the inverter 220.

When a last gate line in the second region 110*b* is turned on, an another inverter control signal generated from the signal synchronism part 208 is applied to the inverter 220, so that the inverter 220 stops providing the electric power to the second lamp 211*b* to turn off the second lamp 211*b* during the period demanded for completely arranging the liquid crystal in the second region 110*b*.

When the liquid crystal is completely arranged in the second region 110*b*, the inverter 220 supplies the second lamp

211*b* with the electric power, and the second lamp 211*b* is maintained at the turn-on state by the inverter 220 until one frame of images is displayed.

Then, as shown in FIGS. 7 to 11, the above-described processes through the first region 110*a* and the second region 110*b* is repeated for the third, fourth, fifth and sixth region 110*c*, 110*d*, 110*e* and 110*f*. Accordingly, one frame of image is displayed by the processes through the first, second, third, fourth, fifth and sixth region 110*a*, 110*b*, 110*c*, 110*d*, 110*e* and 110*f*.

Those processes are repeated by 60 times per second, i.e. by 60 Hz.

Above process, in which the lamps are turned off in the region where the liquid crystal is not completely arranged, can prevent the brightness deterioration due to a short turn-on period of the lamp without increasing a frequency for driving one frame in comparison with the conventional process in which the lamps are turned on directly after all the gate lines in one frame are turned on.

Figure 12:
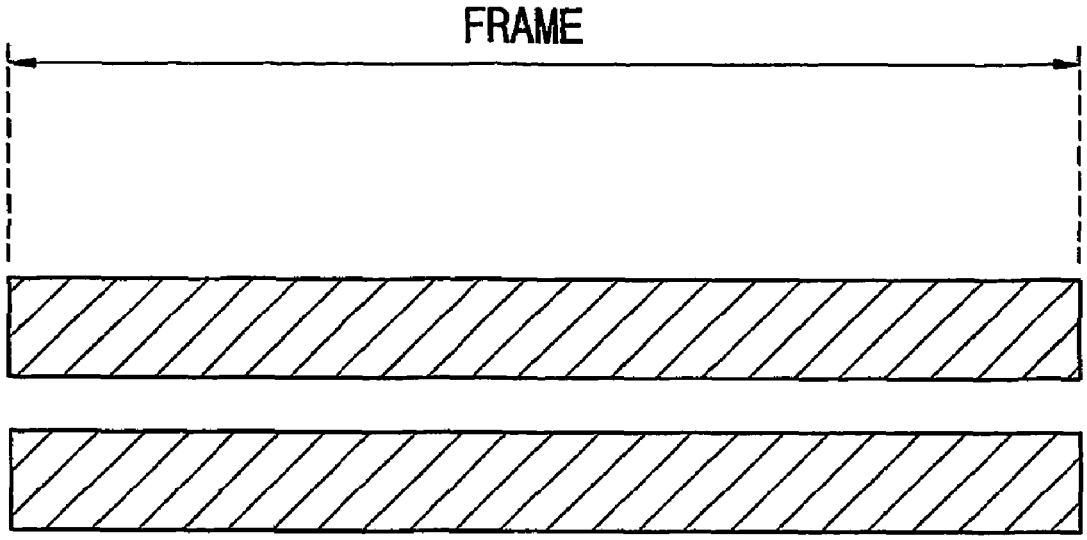
FIG. 12 is a graph illustrating a period during which a light is supplied in one frame when liquid crystal display device operates according to one embodiment of the present invention.

FIG. 12 is a graph illustrating a period during which a light is supplied in one frame when liquid crystal display device operates according to one embodiment of the present invention.

Figure 1:
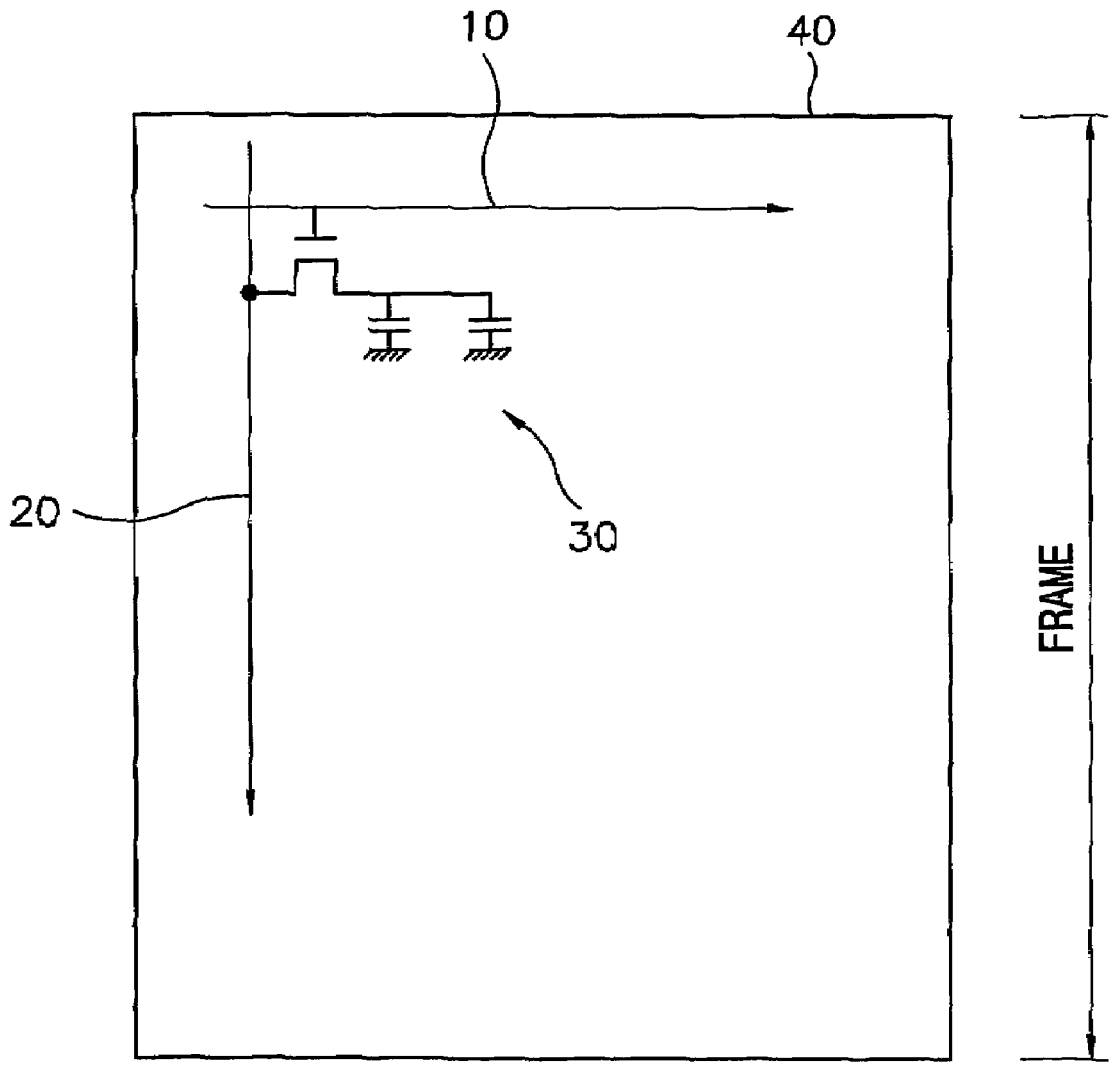
FIG. 1 is a schematic plane view explaining a conventional method for driving a liquid crystal display device.
Figure 2:
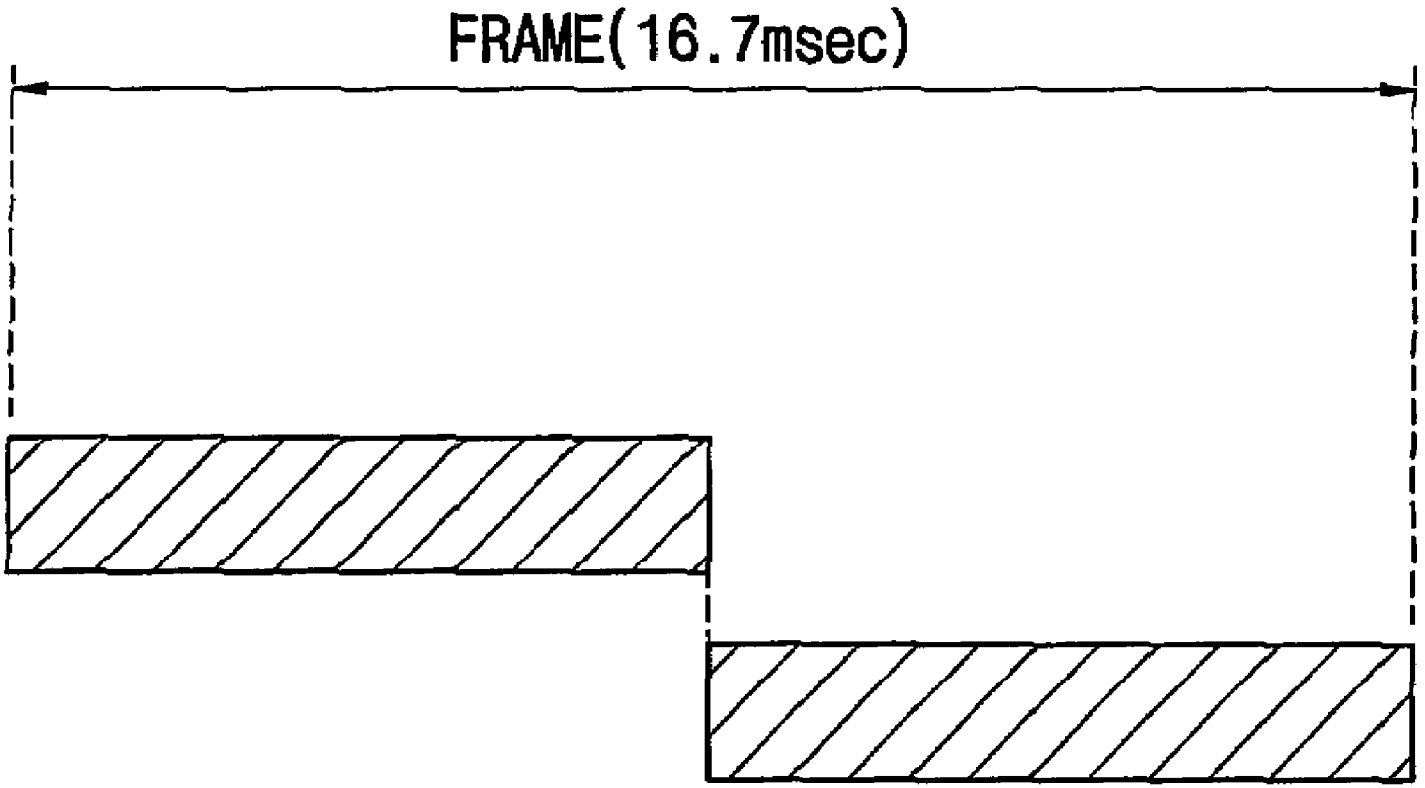
FIG. 2 is a graph showing a period during which a light is supplied in one frame when the conventional liquid crystal display device operates.

Referring to FIG. 12, a light supply time is greatly increased in comparison with the conventional liquid crystal display device shown in FIG. 2. Hence, the brightness is exceedingly improved in accordance with an increased period for being supplied with lights, thereby greatly enhancing the display quality of the image.

According to the present invention, in a state in which the effective display area of the liquid crystal display panel is imaginarily divided into a region (or regions) in accordance with the number of the lamps, after all the thin film transistors in a specific region of the liquid crystal display panel is turned on, the light is supplied to the liquid crystal in the specific region when the liquid crystal in the specific region is completely arranged in the direction of the applied electric field, but the light is not applied to the liquid crystal until the liquid crystal in the specific region is completely arranged. Therefore, the image spreading phenomenon and the image distortion phenomenon can be prevented when the moving images are displayed. Also, the deterioration of the brightness can be prevented.

Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. A liquid crystal display device comprising:

a liquid crystal display panel including a liquid crystal interposed between two substrates, and a plurality of gate lines; and a backlight assembly having i) a signal synchronism part for detecting a gate line to which a gate driving signal is applied and generating an inverter control signal, ii) an inverter for receiving the inverter control signal to generate a lamp driving signal, and iii) at least two lamps parallel disposed under the liquid crystal display panel to be turned on or off in response to the lamp driving signal, wherein the inverter control signal generated from the signal synchronism part is a signal for turning off a portion of the lamps to stop supplying light to the liquid crystal corresponding to the gate line to which the gate driving signal is applied during a predetermined period of arranging the liquid crystal, after the gate driving signal is applied to the corresponding gate line, wherein the backlight assembly supplies the liquid crystal display panel with light continuously during one frame.

2. The liquid crystal device of claim 1, wherein the predetermined period starts when the gate driving signal is applied to the corresponding gate line, and ends when the arrangement of the liquid crystal corresponding to the gate line to which the gate driving signal is applied is completed.

3. The liquid crystal display device of claim 1, wherein the gate lines of the liquid crystal display panel are divided into a plurality of groups corresponding to positions of the lamps, the gate lines of each group are turned on sequentially, and a lamp corresponding to a group including the gate line to which the gate driving signal is applied is turned off in response to the inverter control signal during the predetermined period after a last gate line of the corresponding group is turned on.

4. The liquid crystal display device of claim 3, wherein the lamp corresponding to each group is continuously turned on during one frame after the predetermined period.

5. The liquid crystal display device of claim 3, wherein the predetermined period starts when the gate driving signal is applied to the last gate line of the corresponding group, and ends when an arrangement of the liquid crystal corresponding to the last gate line of the corresponding group is completed.

6. The liquid crystal display device of claim 1, wherein the turned off lamp is continuously turned on during one frame after the predetermined period.

7. A method for driving a liquid crystal display device comprising the steps of:

i) applying an electric field to a liquid crystal included in a first region of a liquid crystal display panel to arrange the liquid crystal, the liquid crystal display panel being divided into a plurality of regions, each region comprising a plurality of gate lines, wherein a gate-on voltage is applied to the gate lines sequentially from a first gate line to a last gate line in each region;

ii) stopping supplying a light to the liquid crystal included in the first region during a predetermined period of arranging the liquid crystal included in the first region, upon application of the gate-on voltage to the last gate line in the first region;

iii) supplying the light to the liquid crystal included in the first region after the predetermined period of arranging the liquid crystal included in the first region; and iv) repeating the steps ii) and iii) concerning liquid crystals included in other regions of the liquid crystal display panel, wherein the light is continuously supplied to the liquid crystal display panel during one frame.

8. A liquid crystal display device, comprising:

a liquid crystal display panel including a liquid crystal interposed between two substrates, and a plurality of gate lines; and a backlight assembly having i) a signal synchronism part for detecting a gate line to which a gate driving signal is applied and generating an inverter control signal, ii) an inverter for receiving the inverter control signal to generate a lamp driving signal, and iii) at least two lamps parallel disposed under the liquid crystal display panel to be turned on or off in response to the lamp driving signal, wherein the gate lines are divided into a plurality of groups corresponding to positions of the lamps, the gate lines of each group are turned on sequentially, and a lamp corresponding to each group is turned off in response to the inverter control signal during a predetermined period of arranging the liquid crystal after a last gate line of each group is turned on, wherein the backlight assembly supplies the liquid crystal display panel with light continuously during one frame.

9. The liquid crystal display device of claim 8, wherein the predetermined period starts when the gate driving signal is applied to a last gate line of the corresponding group, and ends when an arrangement of the liquid crystal corresponding to the last gate line of the corresponding group is completed.

10. The liquid crystal display device of claim 8, wherein the lamp is turned on at the end of the predetermined period and remains on until the signal synchronism part detects the next application of the gate driving signal to the last gate line of the corresponding group.

11. The liquid crystal display device of claim 8, wherein the lamp corresponding to each group is continuously turned on during one frame after the predetermined period.

* * * * *